US011486079B2

(12) United States Patent
Li

(10) Patent No.: US 11,486,079 B2
(45) Date of Patent: Nov. 1, 2022

(54) LAUNDRY BOX AND MACHINE FOR SEPARATELY WASHING CLOTHES

(71) Applicant: Jian Li, Jining (CN)

(72) Inventor: Jian Li, Jining (CN)

( * ) Notice: Subject to any disclaimer, the term of this patent is extended or adjusted under 35 U.S.C. 154(b) by 68 days.

(21) Appl. No.: 16/931,483

(22) Filed: Jul. 17, 2020

(65) Prior Publication Data

US 2020/0347539 A1 Nov. 5, 2020

(30) Foreign Application Priority Data

Jun. 15, 2020 (CN) ..... 202021099686.1

(51) Int. Cl.

| | |
|---|---|
| ***D06F 39/08*** | (2006.01) |
| ***D06F 19/00*** | (2006.01) |
| ***D06F 95/00*** | (2006.01) |
| ***D06F 35/00*** | (2006.01) |
| ***D06F 34/10*** | (2020.01) |
| ***D06F 58/10*** | (2006.01) |
| ***D06F 25/00*** | (2006.01) |
| ***D06F 34/32*** | (2020.01) |

(52) U.S. Cl.

CPC ..... *D06F 39/083* (2013.01); *D06F 19/00* (2013.01); *D06F 25/00* (2013.01); *D06F 34/10* (2020.02); *D06F 34/32* (2020.02); *D06F 35/00* (2013.01); *D06F 58/10* (2013.01); *D06F 95/008* (2013.01)

(58) Field of Classification Search

CPC ..... D06F 95/008

See application file for complete search history.

(56) References Cited

FOREIGN PATENT DOCUMENTS

KR 20080078404 A * 8/2008

* cited by examiner

*Primary Examiner* — Spencer E. Bell

(57) ABSTRACT

The present invention discloses a laundry box, comprising a laundry box body, a seal cover and a drain fence, wherein laundry box water inlets and a laundry box drain outlet are provided at the bottom of the laundry box body, a decontamination conductor plate is provided in the middle thereof, a clothes placing port is provided at the top of the laundry box body, and the seal cover is hinged at the clothes placing port; and the drain fence is detachably mounted inside the laundry box body and is located at the side end close to the drain outlet. The present invention further discloses a machine for separately washing clothes designed to be used in conjunction with the laundry box, comprising a housing, a main machine, a cover plate and at least two laundry boxes.

8 Claims, 7 Drawing Sheets

LAUNDRY BOX AND MACHINE FOR SEPARATELY WASHING CLOTHES

TECHNICAL FIELD

The present invention relates to the technical field of laundry equipment, more particularly to a laundry box and machine for separately washing clothes.

BACKGROUND

At present, with the development of social economy, all kinds of fully automatic washing machines bring great convenience to people's life, especially for young people, save the labor time and labor intensity of doing housework, and improve the happiness index of life, thus being favored by young people.

However, the ordinary washing machine in the prior art cannot achieve the separate washing of clothes of different people, so cross infection of bacteria and viruses is easy to occur, and is not suitable for people having high requirements on sanitary conditions such as infants, children and women; moreover, is not suitable for washing underwear, especially is not suitable for washing female bras, because bras may not only be contaminated with bacteria due to sanitary problems, but also may be deformed in the washing process. Meanwhile, for the traditional washing machine, there is a need to inject a lot of water, no matter how many pieces of clothes are washed, as long as the machine is turned on, it needs to be fully loaded, which costs water and electricity, causing waste of resources.

Therefore, how to provide a laundry box and machine for separately washing clothes is a problem to be urgently solved by those skilled in the art.

SUMMARY

In view of this, the present invention provides a laundry box and machine for separately washing clothes. The independent laundry box is designed as a box for containing clothes and water, may be inserted in any laundry box slot of the main machine, and can be used as long as being inserted. One main machine of the machine for separately washing clothes drives a plurality of laundry boxes to wash clothes simultaneously, so different clothes are separately washed, the laundry boxes are conveniently replaced, health and safety are guaranteed, and cross infection of bacteria is avoided.

To achieve the above purpose, the present invention adopts the following technical solution:

A laundry box, comprising a laundry box body, a seal cover and a drain fence, wherein laundry box water inlets and a laundry box drain outlet are provided at the bottom of the laundry box body, a decontamination conductor plate is provided in the middle thereof, a clothes placing port is provided at the top of the laundry box body, and the seal cover is hinged at the clothes placing port; and the drain fence is detachably mounted inside the laundry box body and is located at the side end close to the drain outlet.

The present invention further discloses a machine for separately washing clothes, comprising a housing, a cover plate and at least two laundry boxes as mentioned above, wherein a motor, a control unit and a decontamination device are fixedly mounted in the housing, and both the motor and the decontamination device are electrically connected with the control unit; the cover plate is fixed at the top of the housing and fixedly connected with an output shaft of the motor, and the cover plate is provided with laundry box slots, the laundry boxes are detachably mounted in the slots symmetrically and are detachably connected with the decontamination device respectively, and meanwhile, connection of the water injection, drain and decontamination washing systems is completed.

In the present invention, the washing compartment of the automatic washing machine is separated from the main machine and de-functionalized, is completely designed as a box for containing clothes and water, and the laundry box is fixed into laundry box slot in a corresponding position. One main machine may drive a plurality of laundry boxes to wash clothes simultaneously, so different clothes are separately washed, and the laundry boxes are conveniently replaced, so safety and health are guaranteed while in use. The seal cover is hinged with the laundry box body, to facilitate clothes to be put in or taken out form the laundry box, moreover, a sealing strip is provided at the seal cover to guarantee that no water leaks in the washing process, and meanwhile, a locking structure is provided to guarantee that the seal cover may be locked and may not be opened by itself in the washing process; and the drain fence is used for isolating clothes from the drain outlet when clothes in the laundry box are spin-dried, to prevent blockage, and meanwhile, the drain fence is detachable, facilitating cleaning and washing.

Preferably, the decontamination device is an ultrasonic generator, a plurality of ultrasonic output terminals of the ultrasonic generator are exposed on the cover plate, and the cover plate is provided with a main machine water inlet, a main machine drain outlet and an air pressure balance port; one end of a main machine water inlet pipe is connected to a water faucet, the other end thereof is connected to the main machine water inlet, a water inlet valve is mounted at the main machine water inlet, the laundry boxes are inserted in the laundry box slots, the main machine water inlet and the air pressure balance port are inserted in the laundry box water inlets, water from the water faucet is controlled by the valve to be injected in the laundry boxes, and connection of a water injection system is completed; the laundry boxes are inserted in the laundry box slots, connection between the laundry box drain outlet and the main machine drain outlet is completed, and a drain valve is mounted at the main machine drain outlet and is connected with a drain pipe, and drains water into the sewage; in the ultrasonic generator, a plurality of ultrasonic output terminals are connected, the laundry boxes are inserted in the slots, the ultrasonic output terminals come into contact with the decontamination conductor plate of the laundry box, and then ultrasonic waves are introduced into the laundry box; in the main machine, the air pressure balance port is connected with atmosphere through an electric control valve, the laundry boxes are inserted in the slots, the main machine water inlet and the air pressure balance port are inserted in the laundry box water inlets, to keep air pressure in the laundry boxes balanced when water is injected in or drained from the laundry boxes; and the air inlet valve, the air discharge valve and the electric control valve are all electrically connected with the control unit.

The main machine controls the opening or closing of the water inlet valve to inject water in the laundry box, the air pressure balance port is controlled to be opened while injecting water, and since the laundry box is a closed container, excess atmospheric pressure is required to be released when injecting water, after injecting water, the main machine controls the water inlet valve and the air pressure balance port to be closed, and starts to control the operation of the ultrasonic generator, the terminals of the ultrasonic generator are closely fitted with the decontamination conductor plate, and thus ultrasonic waves generated by the ultrasonic generator in the main machine are introduced into the laundry boxes to wash the clothes in the laundry boxes; meanwhile, the main machine cover plate drives the laundry boxes to rotate, causing water and clothes in the laundry boxes to be shaken, assisting to complete washing. After the clothes are cleaned, the main machine controls the drain valve and the air pressure balance port to be opened, the main machine cover plate drives the laundry boxes to rotate at high speed to complete clothes dehydration, and water in the laundry boxes is drained into the sewerage.

Preferably, the main machine further comprises a drying device, wherein the laundry boxes are inserted in the slots, the main machine water inlet and the air pressure balance port are inserted in the laundry box water inlets, the laundry box drain outlet is correspondingly connected to the main machine drain outlet, an air outlet pipe of the drying device is in communication with the air pressure balance port, an air return pipe of the drying device is in communication with the main machine drain outlet, hot air is injected in the laundry boxes through the air pressure balance port, and wet-cold air is recovered and circulated through the main machine drain outlet.

Preferably, the side surface of the housing is provided with a main machine power supply switch and a liquid crystal touch control screen, and the two are electrically connected with the control unit.

The beneficial effect produced by adopting the above technical solution is: the side surface of the housing is provided with a main machine power supply switch to facilitate the user to perform ON/OFF of the main machine, and function selection of washing types is performed on the liquid crystal touch control screen, which is convenient in operation and fashionable in appearance.

Preferably, an UV germicidal lamp is also mounted on the cover plate, and the UV germicidal lamp is electrically connected with the control unit; and the laundry box is made of transparent material.

The beneficial effect produced by adopting the above technical solution is: after being turned on, the UV germicidal lamp sterilizes the clothes in the laundry box through the transparent bottom of the laundry box, further enhancing the cleanliness of the clothes.

Preferably, the decontamination conductor plate is made of metal which is easier to introduce ultrasonic waves than other materials, and is used to introduce ultrasonic waves inside the laundry box when clothes are washed, to initiate the cavitation effect in the laundry box, and then wash the clothes.

Preferably, the machine for separately washing clothes further comprises a hood body, wherein the hood body is fixedly mounted on the housing, and covers the main machine and the laundry box therein.

The beneficial effect produced by adopting the above technical solution is: the hood body may cover the front surface of the entire main machine and the laundry box, so when the main machine rotates, no harm may be caused to a person who touches accidentally, and no harm may be caused to the eyes of the person during ultraviolet disinfection, guaranteeing work safety.

Preferably, the housing is mounted on a wall or bracket, to guarantee that the main machine is in an upright state, and mounting on the wall saves space, and mounting on the bracket facilitates movement.

The present invention further discloses a bra-specific laundry box. The laundry box is configured to be in a bra shape, and is internally provided with a bra rack detachably connected with the laundry box body. A bra rack is added in the laundry box, and the bra rack is made of elastic mesh material, to play a role of supporting and fixing bras, so bras are free from friction, twisting and wear in the washing process to guarantee that the bras are not deformed in the washing process. Meanwhile, this laundry box is only used to wash bras, preventing cross-infection of bacteria from other clothes, and guaranteeing safety and health. Adding an underpants rack also has the same beneficial effect.

It can be known from the above technical solution that compared with the prior art, the present invention discloses and provides a laundry box and machine for separately washing clothes, and has the following beneficial effects:

(1) the laundry box is arranged separately, is simple in structure to facilitate cleaning and disinfection, is low in cost so the old one can be replaced with a new one at any time, and is low in price, thus guaranteeing absolute health and safety, (2) is suitable for washing small clothes such as underwear, socks, female bras and summer clothes, thus further guaranteeing health and safety if different kinds of clothes are put into different laundry boxes and are separately washed;

(3) different persons use their own laundry-boxes to prevent cross-infection of bacteria, which are suitable for people having high requirements on sanitary conditions such as infants, children and women, different clothes are separately washed and sterilized and disinfected, thus guaranteeing health and safety;

(4) the laundry box is smaller in size, thus having the advantages of water saving and power saving, energy saving and environmental protection as compared with that of the traditional washing machine; and (5) is suitable for public places where persons are intensively lived, such as hotels, schools, unit staff quarters or hospitals; each person only needs to hold their own laundry box and insert same in a common main machine to wash their own small clothes, which provides convenience for the persons going out guaranteeing cleanliness and health.

DESCRIPTION OF DRAWINGS

To more clearly describe the technical solution in the embodiments of the present invention or in the prior art, the drawings required to be used in the description of the embodiments or the prior art will be simply presented below. Apparently, the drawings in the following description are merely the embodiments of the present invention, and for those ordinary skilled in the art, other drawings can also be obtained according to the provided drawings without contributing creative labor.

Figure 1:
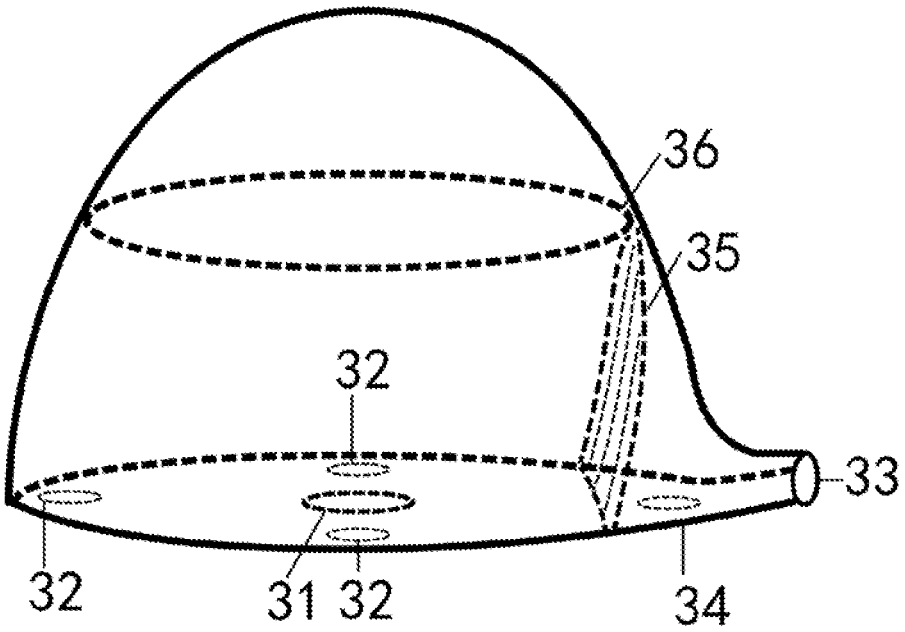
FIG. 1 is a structural schematic diagram of a laundry box provided by the present invention.
Figure 2:
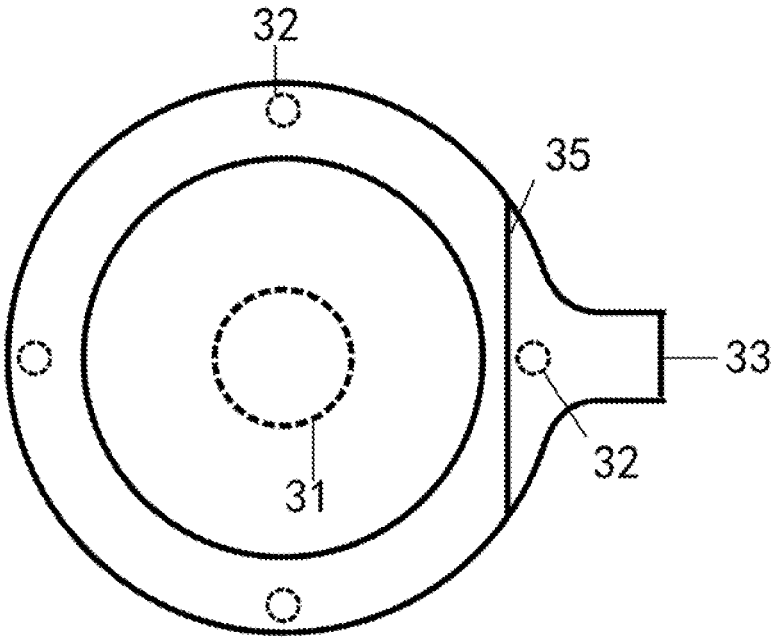
FIG. 2 is a top view of a laundry box provided by the present invention.

In the drawings: the reference numerals are as follows:

1-1—housing; 2—cover plate; 3—laundry box; 21—ultrasonic generator terminal; 22—main machine water inlet and air pressure balance port; 221—main machine water inlet; 23—first drain outlet; 222—air pressure balance port; 31—decontamination conductor plate; 32—water inlet; 33—drain outlet; 34—laundry box body; 35—drain fence; 36—seal cover, 4—power supply line; 5—main machine water inlet pipe; 6—drain pipe; 7—bra rack; 8—main machine power supply switch; 9—liquid crystal touch control screen; 10—UV germicidal lamp; 11—parent bolt for fixing rack; 12—child bolt for fixing rack.

DETAILED DESCRIPTION

The technical solution in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

Referring to FIG. 1, embodiment 1 of the present invention discloses a laundry box, comprising a laundry box body 34, a seal cover 36 and a drain fence 35, wherein laundry box water inlets 32 and a laundry box drain outlet 33 are provided at the bottom of the laundry box body 34, a decontamination conductor plate 31 is provided in the middle thereof, a clothes placing port is provided at the top of the laundry box body 34, and the seal cover 36 is hinged at the clothes placing pot; and the drain fence 35 is detachably mounted inside the laundry box body 34 and is located at the side end close to the drain outlet.

In embodiment 1 of the present invention, the washing compartment of the automatic washing machine is separated from the main machine and de-functionalized, is completely designed as a box for containing clothes and water. One main machine may drive a plurality of laundry boxes to wash clothes simultaneously, so different clothes are separately washed, and the laundry boxes are conveniently replaced, so safety and health are guaranteed while in use. The seal cover 36 is hinged with the laundry box body 34, to facilitate clothes to be put in or taken out form the laundry box, moreover, a sealing strip is provided at the seal cover to guarantee that no water leaks in the washing process, and meanwhile, a locking structure is provided to guarantee that the seal cover 36 may be locked and may not be opened by itself in the washing process; and the drain fence 35 is used for isolating clothes from the drain outlet when clothes in the laundry box are spin-dried, to prevent blockage, and meanwhile, the drain fence 35 is detachable, facilitating cleaning and washing.

Figure 3:
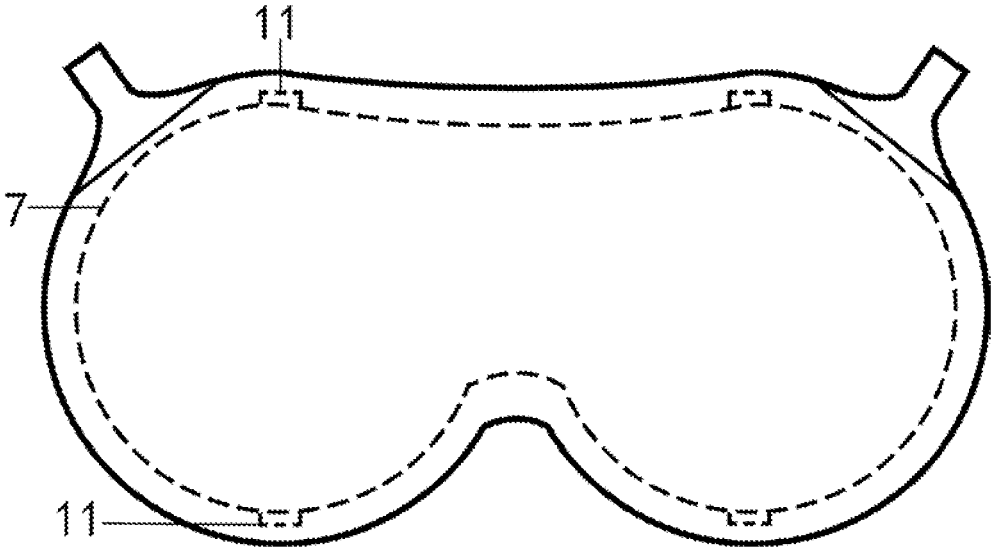
FIG. 3 is a structural schematic diagram of a bra-specific laundry box provided by the present invention.
Figure 4:
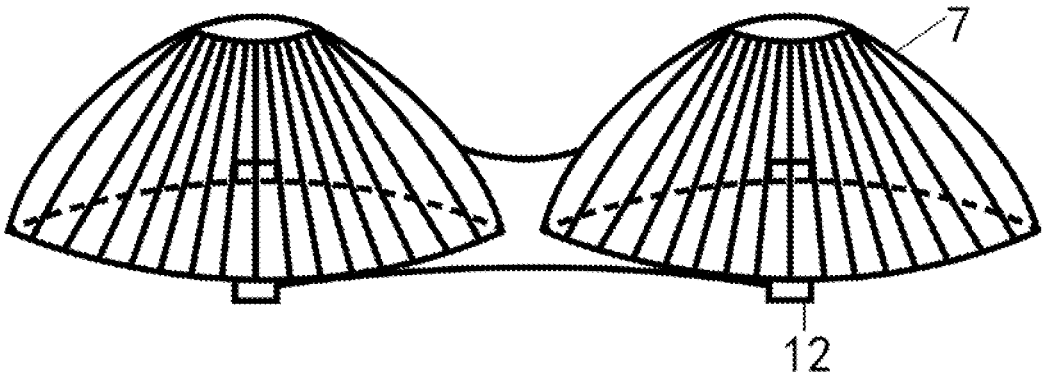
FIG. 4 is a structural schematic diagram of a bra rack provided by the present invention.
Figure 5:
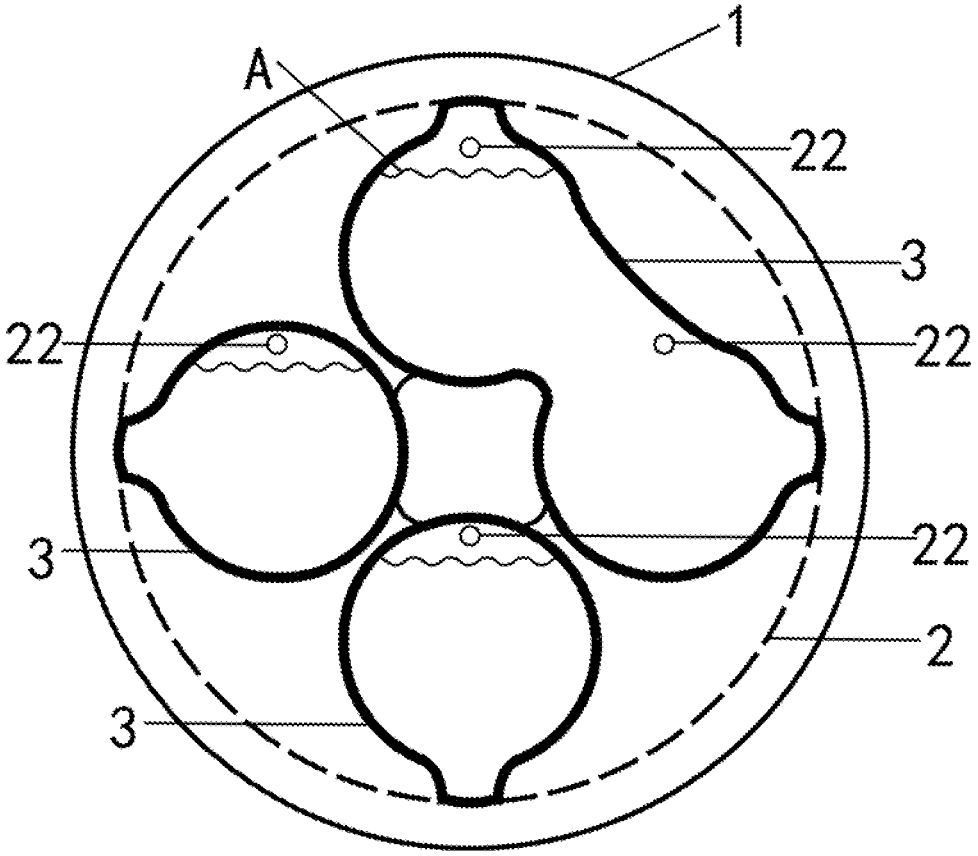
FIG. 5 is a structural schematic diagram provided by the present invention.
Figure 6:
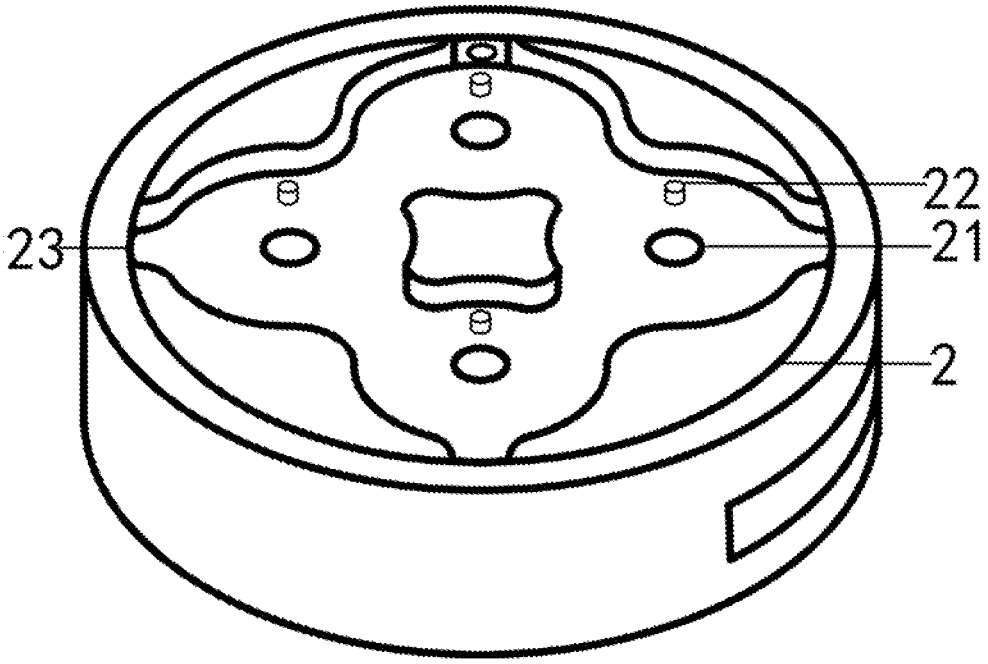
FIG. 6 is a structural schematic diagram of a main machine, housing and cover plate provided by the present invention.
Figure 7:
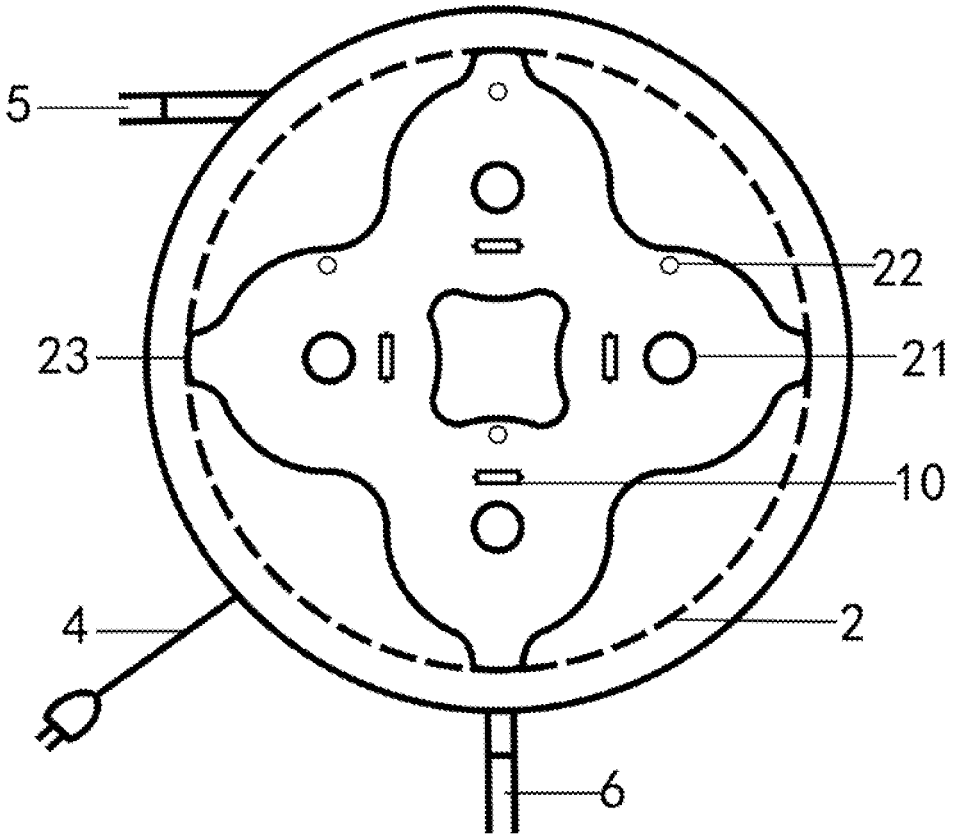
FIG. 7 is a front view of a main machine, housing and cover plate provided by the present invention.
Figure 8:
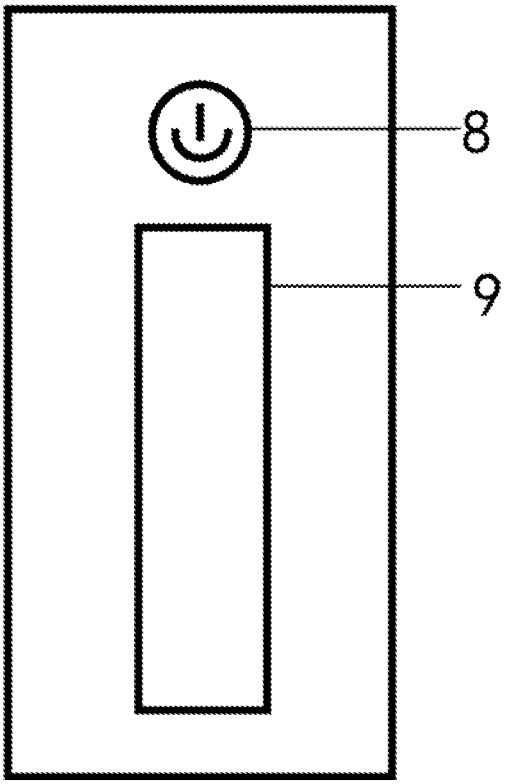
FIG. 8 is a side view of a housing provided by the present invention.
Figure 9:
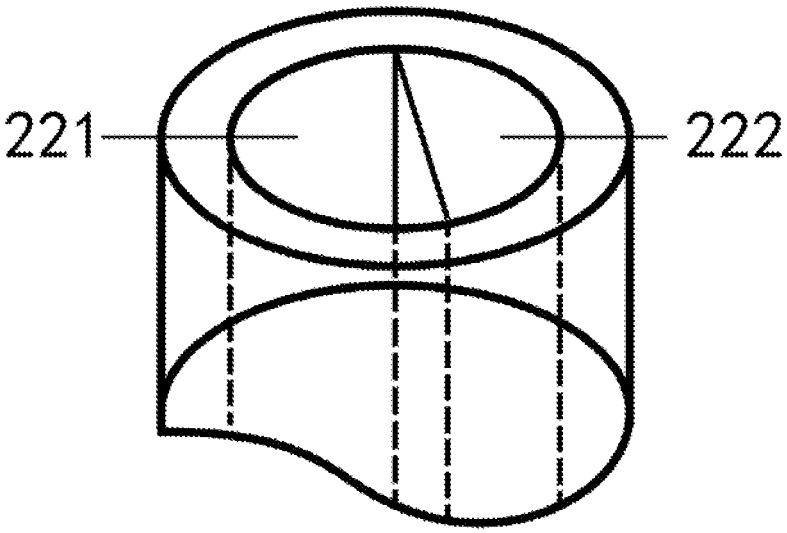
FIG. 9 is a structural schematic diagram of a first water inlet provided by the present invention.

Referring to FIGS. 3-4, embodiment 2 of the present invention discloses a laundry box, wherein a bra rack 7 is internally mounted in the laundry box, and the bra rack 7 is detachably connected with the laundry box body 34.

Bras are fixed in the laundry box for washing to prevent friction and deformation in the washing process. A bra rack is added in the laundry box, and the bra rack 7 is made of elastic mesh material to play a role of supporting and fixing bras, so bras are free from friction, twisting and wear in the washing process to guarantee that the bras are not deformed in the washing process. Meanwhile, this laundry box is only used to wash bras, preventing cross-infection of bacteria from other clothes, and guaranteeing safety and health. Arranging an underpants rack also has the same beneficial effect when used for washing underpants.

Referring to FIGS. 5-9, embodiment 3 of the present invention further discloses a machine for separately washing clothes, comprising a housing 1, a cover plate, a motor, a control unit, a decontamination device, two ordinary laundry boxes and a bra-specific laundry box, wherein the decontamination device is an ultrasonic generator, and both the motor and the ultrasonic generator are electrically connected with the control unit; the cover plate is fixed at the top of the housing 1 and is fixedly connected with an output shaft of the motor, the laundry boxes 3 are detachably mounted on the cover plate and are fixedly connected with the corresponding ultrasonic generator, ultrasonic terminals 21 of the ultrasonic generator, main machine water inlets and air pressure balance ports 22, and a main machine drain outlet 23 are exposed on the cover plate, the laundry box 3 is provided with a decontamination conductor plate 31, laundry box water inlets 32 and a laundry box drain outlet 33; a plurality of ultrasonic output terminals 21 of the ultrasonic generator are exposed on the cover plate 2, and the cover plate is provided with a main machine water inlet 221, a main machine drain outlet 23 and an air pressure balance port 222; the main machine water inlet 221 is separated from the air pressure balance port 222 by a partition plate; one end of a main machine water inlet pipe 5 is connected to a water faucet, the other end thereof is connected to the main machine water inlet 221, a water inlet valve is mounted at the main machine water inlet 221, the laundry boxes are inserted in the laundry box slots, the main machine water inlet 221 and the air pressure balance port 222 are inserted in the laundry box water inlets 32, water from the water faucet is controlled by the valve to be injected in the laundry boxes, and connection of a water injection system is completed; the laundry boxes are inserted in the slots, connection between the laundry box drain outlet 33 and the main machine drain outlet 23 is completed, and a drain valve is mounted at the main machine drain outlet 23 and is connected with a drain pipe 6, and drains water into the sewage; in the ultrasonic generator, a plurality of ultrasonic output terminals 21 are connected, the laundry boxes are inserted in the slots, the ultrasonic output terminals 21 come into contact with the decontamination conductor plate 31 of the laundry box, and then ultrasonic waves are introduced into the laundry box; in the main machine, the air pressure balance port 222 is connected with atmosphere through an electric control valve, the laundry boxes are inserted in the slots, the main machine water inlets and air pressure balance ports 22 are inserted in the laundry box water inlets 32, to keep air pressure in the laundry boxes balanced and when water is injected in or drained from the laundry boxes; and the air inlet valve, the air discharge valve and the electric control valve are all electrically connected with the control unit.

Embodiment 3 of the present invention discloses a machine for separately washing clothes which must be kept in an upright state during operation. When water is injected into the laundry boxes, the main machine water inlet and the air pressure balance port 222 are required to be always kept above the water mark to guarantee that the air pressure balance port 222 can operate normally. In embodiment 3, only four laundry box slots are designed, so four laundry box water inlets 32 are also designed correspondingly. If the main machine needs to be inserted in more than four laundry boxes according to business needs, the laundry box may be designed to be provided with only one water inlet 32, designed as a rotatable structure on the laundry box to correspond to the insertion position of the main machine water inlets and the air pressure balance ports 22.

In the machine for separately washing clothes disclosed by embodiment 3, the washing compartment of the automatic washing machine is separated, is completely designed as a box for containing clothes and water, i.e. a laundry box 3, different types of clothes are put in three laundry boxes 3 so different clothes of the same person can be separately washed, and clothes of the different persons can be separately washed as well, the three laundry boxes are mounted on the motor simultaneously, the motor drives the three laundry boxes 3 to operate simultaneously, so different clothes can be separately washed, avoiding cross-infection of viruses and bacteria caused by washing all clothes in the same laundry box 3, and guaranteeing health and safety. Moreover, the laundry boxes are easy to replace and can be replaced at any time.

Among the three laundry boxes, two ordinary laundry boxes of embodiment 1 and one bra-specific laundry box of embodiment 2 are mounted. At this time, one bra-specific laundry box may also be replaced with two ordinary laundry boxes, which are divided into four ordinary laundry boxes, to separately wash four kinds of clothes.

The main machine illustrated here may be provided with four laundry boxes, and may be provided with 6, 8 and even more ordinary laundry boxes according to product needs as well, any laundry box may be of universal design, may be inserted into any position of the main machine, as long as the symmetrical mounting may allow the main machine to operate.

The laundry box illustrated here may be provided with four laundry box water inlets 32 which are designed for the main machine with four slots, and the main machine water inlet 22 may be inserted in the laundry box at any angle. If the main machine is designed as a main machine with a plurality of laundry boxes, the laundry box water inlet may be fixed to a ring with a rotatable angle at the bottom of the laundry box to match the insertion position of the main machine water inlet 22. When water is injected, the position of the water inlet must be kept above the water mark.

The side surface of the housing 1 is provided with a main machine power supply switch 8 and a liquid crystal touch control screen 9, and the two are electrically connected with the control unit. The main machine power supply switch 8 is provided to facilitate the user to perform ON/OFF of the main machine, and function selection of washing types is performed on the liquid crystal touch control screen 9, which is convenient in operation and fashionable in appearance.

An UV germicidal lamp 10 is also mounted on the cover plate 2, and the UV germicidal lamp is electrically connected with the control unit; and the laundry box 3 is made of transparent material. After being turned on, the UV germicidal lamp 10 sterilizes the clothes in the laundry box 3 through the transparent bottom of the laundry box 3, further enhancing the cleanliness of the clothes.

The decontamination conductor plate 31 is made of metal which is easier to introduce ultrasonic waves than other materials, and is used to introduce ultrasonic waves inside the laundry box when clothes are washed, to initiate the cavitation effect in the laundry box, and then wash the clothes.

The machine for separately washing clothes further comprises a hood body, wherein the hood body is fixedly mounted on the housing 1, and covers the main machine and the laundry box 3 therein. The hood body may cover the front surface of the entire cover plate and the laundry box 3, so when the main machine rotates, no harm may be caused to a person who touches accidentally, and no harm may be caused to the eyes of the person during ultraviolet disinfection, guaranteeing work safety. The housing 1 is fixedly mounted on a wall or bracket, to guarantee that the main machine is in an upright state, and mounting on the wall saves space, and mounting on the bracket facilitates movement.

Embodiment 3 of the present invention has the working process that:

(1) Opening the seal cover 36 of the two ordinary laundry boxes, putting socks to be washed in one laundry box, adding underwear-specific laundry detergent, and locking the seal cover 36; putting underpants to be washed in the other laundry box, adding underwear-specific laundry detergent, and locking the seal cover 36; fixedly mounting the two ordinary laundry boxes on the cover plate 2; opening the bra-specific laundry box, taking out the bra rack, fixing bras to the bra rack, fixing the bra rack in the bra-specific laundry box, adding underwear-specific laundry detergent, and locking the seal cover.

(2) After covering the hood body, turning on the main machine power supply switch 8 to power on, and performing function selection on the liquid crystal touch control screen 9 to start the automatic washing process.

(3) In the main machine, opening the corresponding water inlet valve in FIG. 1, starting to inject water through a water injection port, opening the air pressure balance port at the same time, and releasing excess atmospheric pressure when water is injected since the laundry box is a closed container, wherein since the bra-specific washing box is mounted, the second water inlet at the bottom of the bra-specific laundry box is not activated and is completely sealed.

(4) When the water level in the laundry box reaches about three-quarters of the volume, as shown in FIG. 1, when the water mark A is reached, automatically controlling, by the main machine, stopping of water injection. (Because the laundry boxes and the bra-specific laundry box are all containers with fixed volume and the volume is not large, a controller with multiple water levels is not required, as long as a fixed volume of water is controlled to be injected.)

(5) Starting to release ultrasonic waves by the ultrasonic generator terminals 21, causing a cavitation effect in the laundry box, so after a certain period of time, the stains on the washed clothes are driven to the surface layer of the clothes by the cavitation effect; and at this time, under the drive of the motor, the cover plate 2 starts to alternately rotate at low speed in a clockwise direction and a counterclockwise direction, which causes the water in the laundry box to be shaken, and promotes the stains to be integrated into the laundry water for a certain period of time until washing achieves the best effect.

(6) Opening the drain outlet, and opening the air pressure balance port, so under the drive of the motor, the cover plate starts to rotate at high speed in a clockwise direction so as to drain the water in the laundry boxes and spin-dry the clothes in the laundry boxes.

(7) Repeating the 3-6 processes two or more times, and starting the rinsing process.

(8) Repeating the process (6) for a long time to completely spin-dry the clothes and complete the spin-drying process.

(9) Taking this process as a disinfection process, thus the UV germicidal lamp 10 starts a sterilization process.

(10) Using the air pressure balance port 222 as an air inlet for drying at this time, to spray high-temperature dry air into the laundry boxes, so the main machine alternately rotates at low speed in a clockwise direction and a counterclockwise direction, to allow the clothes to turn and dry in the laundry boxes; and using the second drain outlet as an air outlet for drying, to discharge the wet-hot air to the collector in the main machine, recover wet-hot air, and drain the water into the sewerage through the drain pipe 6; and after the set time is reached, ending the drying process. (This process is suitable for the washing habits of users in Europe, America or Japan, users in mainland China can choose to install it.)

(11) Giving out prompt tone and ending the washing process.

The shell of the main machine can also be designed into a square shape or other shapes, according to the needs of business development and aesthetics.

In the same way, the bra rack design can also be used to design racks for underpants and other clothes to meet the washing requirements of high-grade underwear without deformation and wear.

For the design of the laundry box itself, a folding structure can be considered to facilitate the storage of the laundry box when not in use, which can be considered at the stage of business development.

In this design, by separating the washing compartment of the automatic washing machine, the function of washing clothes according to different categories and according to different persons is realized. Due to the washing design of health and no wear, it is particularly suitable for washing small clothes such as underwear according to different categories.

Therefore, for underwear washing, this will be an innovative change. Once put into service, for each family, the most suitable one for washing underwear is no longer hand washing, but laundry box.

The ultrasonic generator in embodiment 3 may be replaced with an electrolyzed water device, and for the decontamination conductor plate of a corresponding laundry box, the decontamination conductor plate may be replaced with an electrolysis electrode, as long as the device capable of achieving decontamination is mounted on the main machine, which should fall within the protection scope of the present invention.

Figure 10:
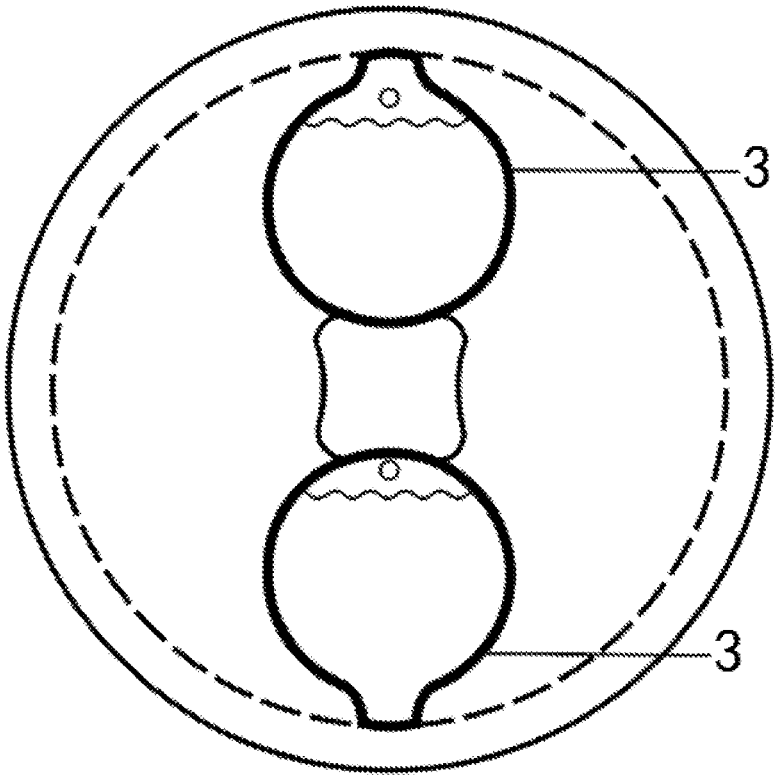
FIG. 10 is a structural schematic diagram of embodiment 4 provided by the present invention.

As shown in FIG. 10, the machine for separately washing clothes disclosed in embodiment 4 of the present invention is different from that in embodiment 3 in that two ordinary laundry boxes are symmetrically inserted in the main machine for personal use at ordinary times, one can be used to wash socks and the other can be used to wash underpants, wherein, symmetrical insertion is to guarantee weight balance during rotation.

It should be noted that in embodiment 4, any ordinary laundry box may be replaced with a counterweight box, wherein the structure of the counterweight box is completely identical to that of the laundry box, only the weight thereof is equivalent to the weight of the laundry box after adding water. This guarantees that even one laundry box can be used alone!

Figure 11:
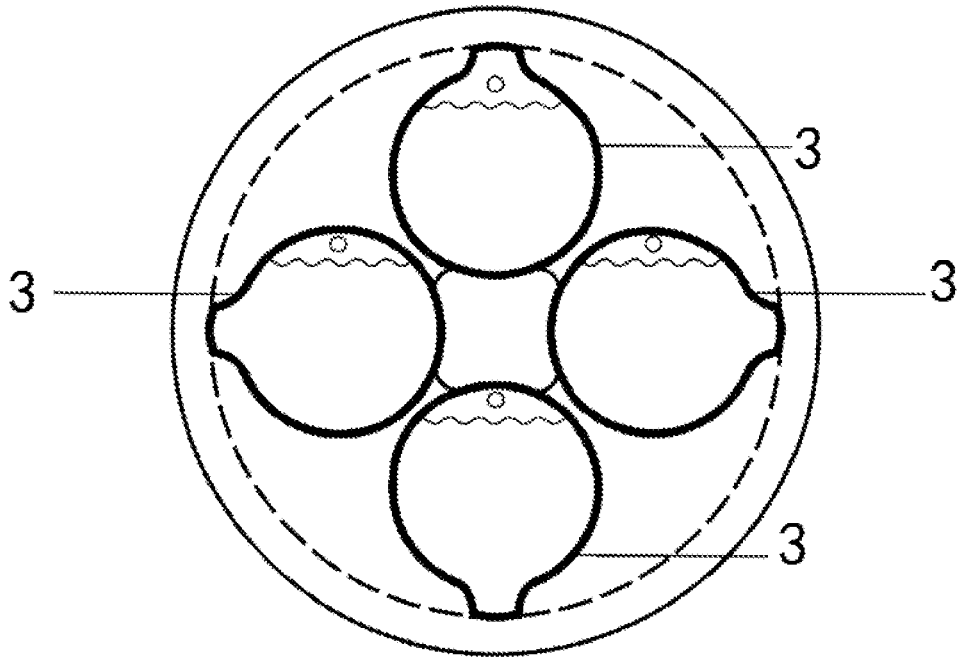
FIG. 11 is a structural schematic diagram of embodiment 5 provided by the present invention.

As shown in FIG. 11, the machine for separately washing clothes disclosed in embodiment 5 of the present invention is different from that in embodiment 3 in that four ordinary laundry boxes are symmetrically inserted in the main machine, which can be used to wash underwear and socks of two persons or different clothes.

Each embodiment in the description is described in a progressive way. The difference of each embodiment from each other is the focus of explanation. The same and similar parts among all of the embodiments can be referred to each other. For the device disclosed by the embodiments, because the device corresponds to a method disclosed by the embodiments, the device is simply described. Refer to the description of the method part for the related part.

The above description of the disclosed embodiments enables those skilled in the art to realize or use the present invention. Many modifications to these embodiments will be apparent to those skilled in the art. The general principle defined herein can be realized in other embodiments without departing from the spirit or scope of the present invention. Therefore, the present invention will not be limited to these embodiments shown herein, but will conform to the widest scope consistent with the principle and novel features disclosed herein.

The invention claimed is:

1. A machine for separately washing clothes, comprising a housing, a main machine, a cover plate and at least two laundry boxes; wherein the main machine is fixedly mounted in the housing, the main machine comprises a motor, a control unit and a decontamination device, and both the motor and the decontamination device are electrically connected with the control unit; the cover plate is fixed at the top of the housing and is fixedly connected with an output shaft of the motor, the cover plate is provided with laundry box slots, and the laundry boxes are symmetrically inserted in the slots; each of the at least two laundry boxes comprises a laundry box body, a seal cover and a drain fence; laundry box water inlets and a laundry box drain outlet are provided at the bottom of the laundry box body, a decontamination conductor plate is provided in the middle thereof, a clothes placing port is provided at the top of the laundry box body, and the seal cover is hinged at the clothes placing port; and the drain fence is detachably mounted inside the laundry box body and is located at the side end close to the drain outlet.

2. The machine for separately washing clothes of claim 1, wherein the decontamination device is an ultrasonic generator, a plurality of ultrasonic output terminals of the ultrasonic generator are exposed on the cover plate, and the cover plate is provided with a main machine water inlet, an air pressure balance port and a main machine drain outlet; and the main machine water inlet is separated from the air pressure balance port by a partition plate;

one end of a main machine water inlet pipe is connected to a water faucet, the other end thereof is connected to the main machine water inlet, a water inlet valve is mounted at the main machine water inlet; when the laundry boxes are inserted in the slots, the main machine water inlet and the air pressure balance port are inserted in the laundry box water inlets so that water from the water faucet is controlled by the water inlet valve to be injected in the laundry boxes;

when the laundry boxes are inserted in the slots, the laundry box drain outlet is connected with the main machine drain outlet and a drain valve is mounted at the main machine drain outlet and is connected with a drain pipe;

when the laundry boxes are inserted in the slots, the ultrasonic output terminals are in contact with the decontamination conductor plate of the laundry box;

in the main machine, the air pressure balance port is connected with atmosphere through an electric control valve, the laundry boxes are inserted in the slots, the main machine water inlet and the air pressure balance port are inserted in the laundry box water inlets, to keep air pressure in the laundry boxes balanced when water is injected in or drained from the laundry boxes; and the air inlet valve, the air discharge valve and the electric control valve are all electrically connected with the control unit.

3. The machine for separately washing clothes of claim 2, wherein the main machine further comprises a drying device, when the laundry boxes are inserted in the slots, the main machine water inlet and the air pressure balance port are inserted in the laundry box water inlets; and the laundry box drain outlet is correspondingly connected to the main machine drain outlet; an air outlet pipe of the drying device is in communication with the air pressure balance port; and an air return pipe of the drying device is in communication with the main machine drain outlet.

4. The machine for separately washing clothes of claim 2, wherein a side surface of the housing is provided with a main machine power supply switch and a liquid crystal touch control screen, and the two are connected with the control unit, to realize automatic washing control.

5. The machine for separately washing clothes of claim 1, wherein a UV germicidal lamp is also mounted on the cover plate, and the UV germicidal lamp is electrically connected with the control unit; and the laundry box is made of transparent material.

6. The machine for separately washing clothes of claim 5, wherein the decontamination conductor plate is made of metal material.

7. The machine for separately washing clothes of claim 5, further comprising a hood body, wherein the hood body is fixedly mounted on the housing, and covers the main machine, the cover plate and the laundry box therein.

8. The machine for separately washing clothes of claim 5, wherein the housing is fixedly mounted on a wall or bracket, to guarantee that the main machine is in an upright state.

* * * * *